United States Patent [19]

Parker

[11] Patent Number: 4,958,798

[45] Date of Patent: Sep. 25, 1990

[54] COCKTAIL NAPKIN

[76] Inventor: Julie W. Parker, 2379 Neil Ave., Columbus, Ohio 43202

[21] Appl. No.: 884,022

[22] Filed: Jul. 10, 1986

[51] Int. Cl.[5] ..... A47G 11/00

[52] U.S. Cl. ..... 248/346.1; 215/100.5; D6/613

[58] Field of Search ..... 248/346.1; D6/613, 614, D6/615, 616, 595; 428/452; 215/100.5

[56] References Cited

U.S. PATENT DOCUMENTS

| | | | |
|---|---|---|---|
| D. 166,208 | 3/1952 | Meyer | D6/595 |
| D. 176,809 | 1/1956 | Nelezen | D6/595 |
| 3,195,847 | 7/1965 | Squires | 248/346.1 |
| 4,000,028 | 12/1976 | Hoey | 428/314.2 |
| 4,423,101 | 12/1983 | Willstead | 428/315.7 X |
| 4,433,823 | 2/1984 | Pearson | 248/346.1 |

FOREIGN PATENT DOCUMENTS

| | | | |
|---|---|---|---|
| 132260 | 7/1902 | Fed. Rep. of Germany | 248/346.1 |

*Primary Examiner*—David L. Talbott

[57] ABSTRACT

Sticking or clinging of a cocktail napkin to a cocktail glass is prevented by a layer of porous siliconized paper between the base of the glass and the top surface of the napkin. This provides a water repellant barrier to accumulation of a film of water between the glass and the top surface of the napkin.

4 Claims, 1 Drawing Sheet

COCKTAIL NAPKIN

Cocktail napkins are usually made of absorbent paper two or three-ply overprinted with an attractive design. These napkins are manufactured folded into squares and are used unfolded to serve as coasters. When so used, the condensation of moisture on the outside of the cocktail glass runs down into the napkin and forms a film of water between the bottom of the glass and the napkin so that when the glass is lifted the napkin comes with it and while the napkin can be easily removed, it frequently is dropped to the floor and discarded and a new napkin used.

This invention is intended to solve the problem of adherence of the cocktail napkin to the glass by a siliconized porous top layer on the napkin so that although the condensed moisture runs down the glass it runs through the siliconized layer and does not form a film of water between the glass and the top surface of the napkin. Cocktail napkins with the siliconized top layer when used as coasters are never picked up when the glass is lifted and remain in place to serve their purpose.

Figure 1:
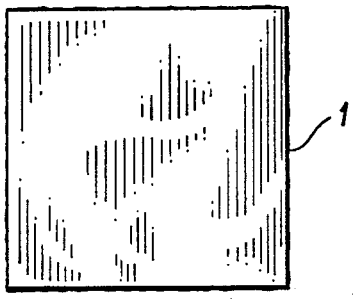
FIG. 1 is a top plan view of a folded cocktail napkin.
Figure 2:
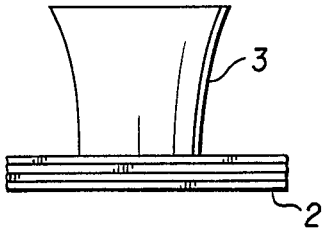
FIG. 2 is a side elevation of a cocktail glass resting on the FIG. 1 napkin.

Referring to the drawing, 1 indicates a cocktail napkin made of absorbent paper usually two or three-ply. The peripheral edges may be compressed in a plain or corrugated or other design to more tightly compact the layers and prevent delamination. This would provide a border for the napkin. Usually the napkin has some sort of design which preferably is symmetrical so that when the napkin is folded in quarters, the design still is attractive. In FIG. 2 the napkin 1 has been folded to serve as a coaster 2 for a cocktail glass 3. The condensation of moisture on the outside of the glass runs down and sinks into the napkin at the base 3*a* of the glass forming a layer 4 of water between the napkin and the base. This layer causes the napkin to cling to the base when the glass is lifted and while the cocktail napkin may be easily removed, it does not always get back in place and sometimes lands on the floor and is thrown away. This results in a rather large usage of cocktail napkins.

Figure 3:
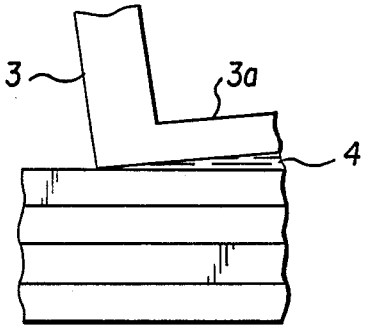
FIG. 3 is a fragmentary section through a two-ply cocktail napkin.
Figure 4:
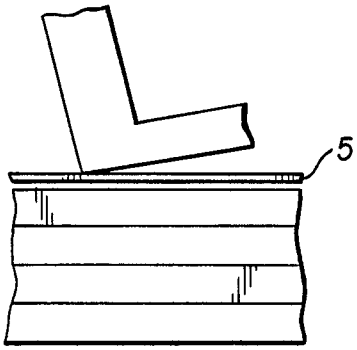
FIG. 4 is an enlarged diagrammatic section similar to FIG. 3 to which has been added a tissue thin porous top layer of siliconized paper which prevents the build-up of a liquid layer between the top layer and the cocktail glass.

FIG. 3 shows a two-layer construction of a standard napkin greatly enlarged. Over the central portion of the napkin the layers are not intimately bonded together but the peripheral edges of the napkin where the edges have been compressed to provide a tear resistant edge, the layers are more intimately bonded together. In FIG. 4 there is superimposed upon the standard napkin structure of FIG. 3 a relatively thin layer of siliconized paper 5 which overlies at least the area of the napkin on which the glass is rested. This layer may be a layer of extremely thin tissue paper of high porosity or it may be a flock of siliconized fibers adhered to the outer surface of the napkin. The properties of the layer 5 are that it be porous and non-adherent to water. With these properties no water can collect between the bottom of the cocktail glass and the napkin and there is no water film which will be present to lift the napkin with the glass. A porous water repellant outer surface and an absorbent under surface is what is required for applicant's napkin.

The manner in which the water repellant sheet 5 is secured in place is not critical. It may be joined only in a few points around the periphery of the napkin. The sheet 5 carries no load. It is only required that the sheet be between the base of the cocktail glass and the upper surface of the napkin. So long as there is a water repellant barrier between the base of the cocktail glass and the napkin, the film of water cannot form and the napkin cannot stick to the glass and be picked up when the glass is lifted.

I claim:

1. A cocktail napkin adapted to serve as a coaster for a cocktail glass, said napkin comprising a body of absorbent paper with an upper porous surface of water repellant material which when the base of a cocktail glass is rested thereon conducts condensed moisture from said base into said absorbent body and prevents the formation of a layer or film of water between said base and the napkin and thereby prevents sticking of the napkin to said base.

2. The napkin of claim 1 in which the upper surface is a thin sheet of tissue paper.

3. The napkin of claim 2 in which the upper surface is a sheet of siliconized tissue paper.

4. A coaster comprising a cocktail napkin of absorbent material having an upper surface on which the base of a cocktail glass is rested, said upper surface being a porous water repellent barrier between the base of the glass and said absorbent material, said barrier and said absorbent material cooperating to prevent the formation of a layer or film of water on said base between said base and said barrier and thereby preventing the sticking of the napkin to said base.

* * * * *